US007318416B1

(12) United States Patent
Stewart

(10) Patent No.: US 7,318,416 B1
(45) Date of Patent: Jan. 15, 2008

(54) LIQUID FUEL PUMP

(76) Inventor: Howard C. Stewart, 222 Hilcrest Dr., High Point, NC (US) 27262

( * ) Notice: Subject to any disclaimer, the term of this patent is extended or adjusted under 35 U.S.C. 154(b) by 256 days.

(21) Appl. No.: 11/101,133

(22) Filed: Apr. 7, 2005

(51) Int. Cl.
*F02M 69/02* (2006.01)
*F04B 17/05* (2006.01)
*F04B 19/20* (2006.01)

(52) U.S. Cl. ..... 123/460; 417/555.1

(58) Field of Classification Search ..... 417/471, 417/549, 553, 555.1; 123/446, 452, 457, 123/460, 447
See application file for complete search history.

(56) References Cited

U.S. PATENT DOCUMENTS

| | | | | |
|---|---|---|---|---|
| 2,064,750 | A | 12/1936 | Hurst | |
| 2,179,354 | A | 11/1939 | Scott | |
| 2,720,842 | A | 10/1955 | Downing | |
| 3,655,296 | A | 4/1972 | McDougall | 417/214 |
| 4,141,675 | A | 2/1979 | O'Neill | 417/214 |
| 4,229,148 | A | 10/1980 | Richmond et al. | 417/485 |
| 4,295,414 | A | 10/1981 | Mochizuki et al. | 92/98 |
| 4,479,759 | A | 10/1984 | Zeitz | 417/500 |
| 4,721,247 | A | 1/1988 | Perr | 239/91 |
| 5,024,587 | A | 6/1991 | Maurer | 417/488 |
| 5,310,252 | A | 5/1994 | Stewart, Jr. | 303/84.2 |
| 5,350,223 | A | 9/1994 | Stewart, Jr. | 303/84.2 |
| 5,415,134 | A | 5/1995 | Stewart, Jr. | 123/41.01 |
| 5,472,320 | A | 12/1995 | Weisbrodt | 417/326 |
| 5,630,656 | A | 5/1997 | Stewart, Jr. | 303/9.62 |
| 5,649,746 | A | 7/1997 | Stewart, Jr. | 303/84.7 |
| 5,701,869 | A * | 12/1997 | Richardson et al. | 123/497 |
| 6,347,614 | B1 | 2/2002 | Evers et al. | 123/446 |
| 6,499,974 | B2 | 12/2002 | Bach | 417/549 |
| 6,764,286 | B2 | 7/2004 | Hunnicutt et al. | 417/470 |
| 7,134,424 | B2 * | 11/2006 | Pehrson et al. | 123/457 |

OTHER PUBLICATIONS

Marlan Davis,"Mechanical EFI Fuel Pump", May 2007, Primedia, Hot Rod Magazine, Jul. 2007 Issue, pp. 132-134, 135.*

* cited by examiner

*Primary Examiner*—Stephen K. Cronin
*Assistant Examiner*—Arnold Castre
(74) *Attorney, Agent, or Firm*—MacCord Mason PLLC

(57) ABSTRACT

A liquid fuel system for an internal combustion engine includes a fuel supply line, a fuel pump connected to the supply line and having an outlet to a carburetor or a liquid fuel injector. A mechanical contact between the pump and a component of the internal combustion engine transmits a cyclic motion from the engine to the pump to cause the pump to pump at a cyclic rate determined by the engine. The pump is a variable displacement pump, so the output flow rate of the pump is diminished by a sufficient backpressure at the outlet of the pump.

21 Claims, 4 Drawing Sheets

LIQUID FUEL PUMP

BACKGROUND OF THE INVENTION

The present invention relates generally to a mechanical fuel pump for an internal combustion engine. More particularly, the invention provides a fuel pump useful with a stock car racing engine that is lighter than prior art fuel pumps and requires a smaller push rod force to provide a higher rate of fuel flow at a greater fuel pressure.

Stock car racing engines are typically required to use mechanical fuel pumps for moving fuel from a fuel tank to a carburetor or fuel injector. Typically, conventional diaphragm pumps are used on these engines. The conventional pumps may be heavy and transfer a significant quantity of heat to the fuel while pumping. They also may require 125 pounds of push rod force to drive the pump. Therefore, a lightweight mechanical fuel pump that transfers a smaller amount of heat to the fuel while providing fuel at a higher rate and at a higher fuel pressure than fuel pumps typically used with stock car racing engines is needed. Also, having the pump operate with variable displacement is advantageous.

SUMMARY OF THE INVENTION

The present invention fulfills one or more of these needs in the art by providing a liquid fuel pump having a body having a bore with an inlet and an outlet transverse to the bore. A shaft is mounted for reciprocation in the bore and has a first end upstream of the inlet, a piston downstream of the first end, and a perforated plate downstream of the piston. A first O-ring engages the shaft downstream of the perforated plate and upstream of the outlet, an annular shoulder extends into the bore downstream of the perforated plate and upstream of the first O-ring, and a second O-ring movably engages the inside of the bore between the piston and the perforated plate downstream of the inlet. Reciprocation of the shaft toward the upstream end causes the first O-ring to engage the annular shoulder and the piston to separate from the second O-ring and allow liquid fuel to pass from the inlet past the piston and through the perforations in the perforated plate but not past the first O-ring. Reciprocation of the shaft toward the downstream end causes the first O-ring to separate from the annular shoulder to enable liquid fuel to flow from upstream of the shoulder to the outlet and causes the piston to engage the second O-ring and thereby occlude the bore to force liquid fuel that is downstream of the piston to move toward the outlet.

In a preferred embodiment the second O-ring is moved downstream by the piston during movement of the shaft toward the downstream end and is moved upstream by the perforated plate during movement of the shaft toward the upstream end.

Typically, the bore extends upstream of the inlet to a closed end and the shaft includes a second piston reciprocating toward and away from the closed end. The closed end need not be sealed to the atmosphere outside the bore. A spring between the closed end and the second piston may be included to cause the reciprocation toward the downstream end. The second piston preferably has a third O-ring to seal the inlet from the closed end.

In many embodiments the bore extends downstream of the outlet to an open end and the shaft includes a portion extending out of the open end to engage a linkage for reciprocation toward the upstream end. The portion extending out of the open end is desirably packed to prevent liquid fuel leakage from the open end.

A spring can be positioned to urge the first O-ring toward the annular shoulder.

The invention can also be considered as a liquid fuel system for an internal combustion engine including a liquid fuel supply line, a liquid fuel pump connected to the liquid fuel supply line and having an outlet to a liquid fuel metering device for an internal combustion engine selected from the group consisting of a carburetor and a liquid fuel injector. A mechanical contact between the liquid fuel pump and a component of the internal combustion engine transmits a cyclic motion from the engine to the pump to cause the pump to pump at a cyclic rate determined by the engine. The liquid fuel pump is a variable displacement pump, so the output liquid fuel flow rate of the pump is diminished by a sufficient backpressure at the outlet of the pump. The pump may include a reciprocating shaft, and the backpressure damps the shaft's movement enough so that the shaft and engine component lose mechanical contact with one another. Typically, the engine component is a pushrod or a cam.

The invention can also be considered as a method of pumping liquid fuel including supplying liquid fuel into a bore in a body through an inlet in the body and then through a first O-ring and perforated plate, moving a shaft in a first direction in the bore to cause a piston to engage the first O-ring and occlude the bore and move a second O-ring out of contact with an annular shoulder in the bore to open a path to an outlet, continuing movement of the shaft to force liquid fuel downstream of the first O-ring towards the outlet, and moving the shaft in a second direction in the bore to disengage the piston from the first O-ring and provide a liquid fuel flow path between them and move the second O-ring into contact with the annular shoulder to block the path to the outlet to resume supplying liquid fuel into the bore through the inlet and through the first O-ring and perforated plate. Movement of the shaft in the first direction may be caused by the force of a spring. Movement of the shaft in the second direction is typically the result of a force imposed by an engine component.

Movement of the shaft in the first direction may be caused by the force of a spring and restrained by backpressure in a liquid fuel line connected to the outlet, causing a variable displacement. The backpressure may damp the shaft's movement in the first direction enough so that the shaft and engine component lose contact with one another.

BRIEF DESCRIPTION OF THE DRAWINGS

The invention will be better understood by a reading of the Detailed Description of the Examples of the Invention along with a review of the drawings, in which.

DETAILED DESCRIPTION OF EXAMPLES OF THE INVENTION

The illustrations are for the purpose of describing an embodiment of the invention and are not intended to limit the invention to the embodiments of the illustrations and descriptions. Those of ordinary skill will recognize that the invention defined by the claims as capable of various and numerous configurations.

Figure 1:
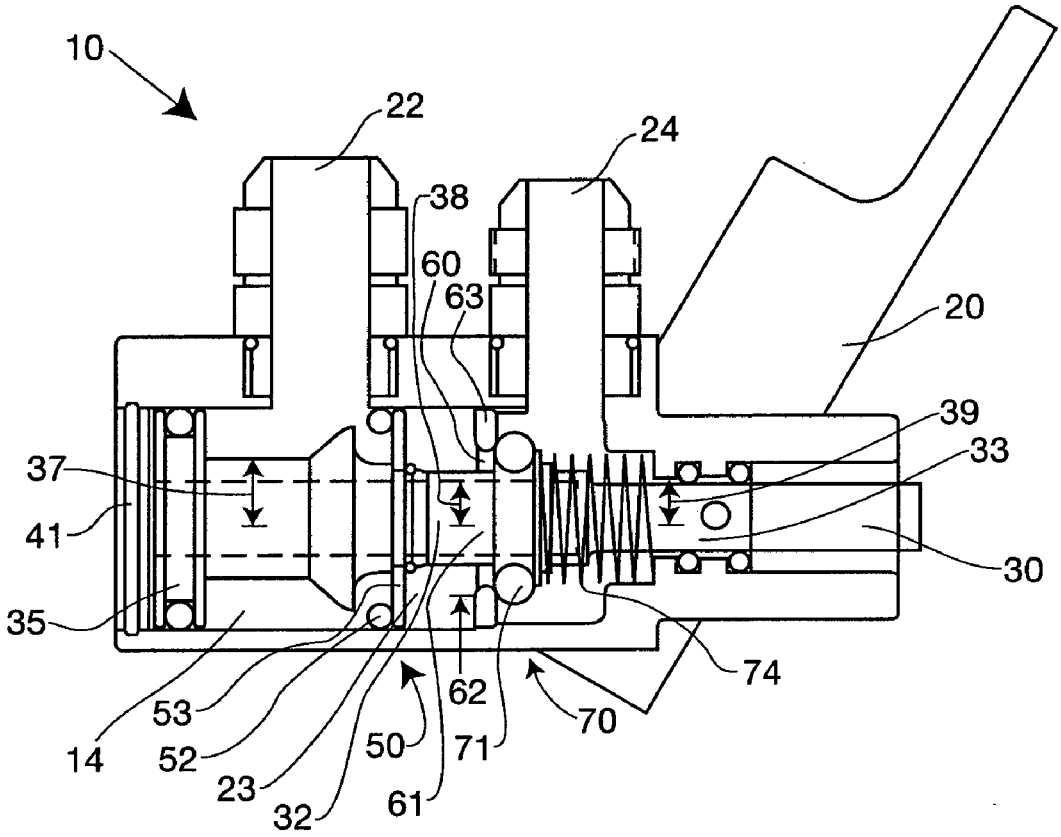
FIG. 1 is a side cross sectional view of a fuel pump according to an embodiment of the invention showing the pump during the induction stroke.

FIG. 1 illustrates a fuel pump 10 constructed according to an embodiment of the invention. The fuel pump 10 includes a housing 20. The housing is preferably constructed of a lightweight, yet durable material and includes a fuel inlet passageway 22, a fuel outlet passageway 24, and a fuel chamber 23 as part of a bore 14 extending the length of the housing 20. The housing 20 has an annular shoulder 63 between the inlet passageway 22 and the outlet passageway 24 surrounding an outlet 60 downstream of the fuel chamber 23.

Figure 2:
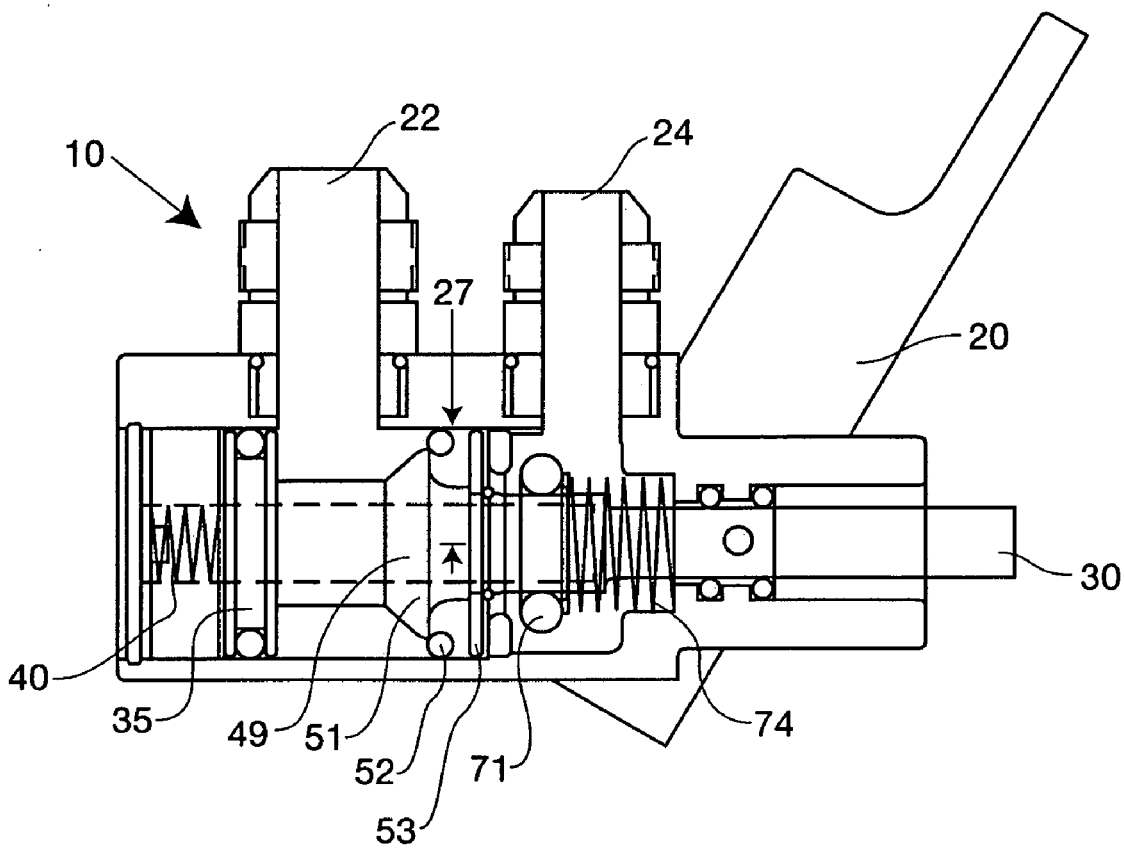
FIG. 2 is a side cross sectional view of the fuel pump showing the pump during the eduction stroke.

FIG. 1 shows a rod 30 with a piston 35 moved within the chamber 23 to enlarge the volume of the fuel chamber 23 in response to a force from a push rod of an engine (not shown). As seen in FIG. 2, a spring 40 is located between a closed end 41 of the housing 20 and the piston 35. The spring 40 biases the piston 35 against the force of the push rod. The piston 35 is provided with an O-ring to prevent fuel from passing toward end 41. End 41 can be vented to atmosphere, or not.

FIG. 1 illustrates the rod 30, which includes: a first cylindrical portion 31 having a radius 37; a second cylindrical portion 32 downstream of the first cylindrical portion 31 having a radius 38 smaller than the radius 37 of the first cylindrical portion 37; and a third cylindrical portion 33 downstream of the second cylindrical portion 32 having a radius 39 smaller than the radius 38 of the second cylindrical portion 32 of the rod 30. The rod 30 also has a piston 49 including substantially wedge shaped portion 51. The piston 35 and the portions 31, 32, and 33, 49 of the rod 30 may be integrally formed. Alternatively, the piston 35 and the portions 31, 32, and 33, 49 may be separate components coupled together. The radius 39 is packed to prevent fuel leakage out of the end of the bore.

A floating seal, or O-ring 52 is downstream of the substantially wedge shaped portion 51. Preferably, the O-ring is a Viton® fluoroelastomer O-ring available from DuPont Dow Elastomers. A stop 53 is also formed on the rod 30 downstream of the O-ring 52. The stop 53 may take the form of a ring coupled in concentric relationship with the rod 30. Spokes extend radially from the rod 30, so the spokes and the ring 56 define a plurality of openings 55 for fuel flow, while also limiting downstream movement of the O-ring 52. The openings can be of various shapes and sizes.

The inside radius of the O-ring 52 is greater than the radius 38 of the second cylindrical portion 32 of the rod 30 to define a passage through which fuel can flow, and is smaller than a greatest radius of the wedge shaped portion 51 of the rod. The outside radius of the O-ring 52 is typically about equal to the radius 27 of the portion of the bore 14 forming the fuel chamber 23, such that when the wedge shaped portion 51 of the rod 30 contacts the O-ring 52, the wedge shaped portion of the rod 51 and the O-ring 52 occlude the chamber to fuel flow.

The annular shoulder 63 at the downstream end of the fuel chamber 23 surrounds an opening 61. A seal, preferably an O-ring, 71 has an outside radius greater than the outside radius of the circular opening 61. A spring 74 biases the O-ring 71 towards the shoulder 63. The O-ring 71 has an inside radius 73 so it stays affixed to and moves with the rod 30 such that when the O-ring 71 contacts the annular shoulder 63 (as in FIG. 1) the O-ring 71 and the rod 30 prevent flow from upstream toward the outlet 24. The O-ring 71 of the outlet flow control device 60 is also preferably a Viton® fluoroelastomer available from DuPont Dow Elastomers.

Figure 4:
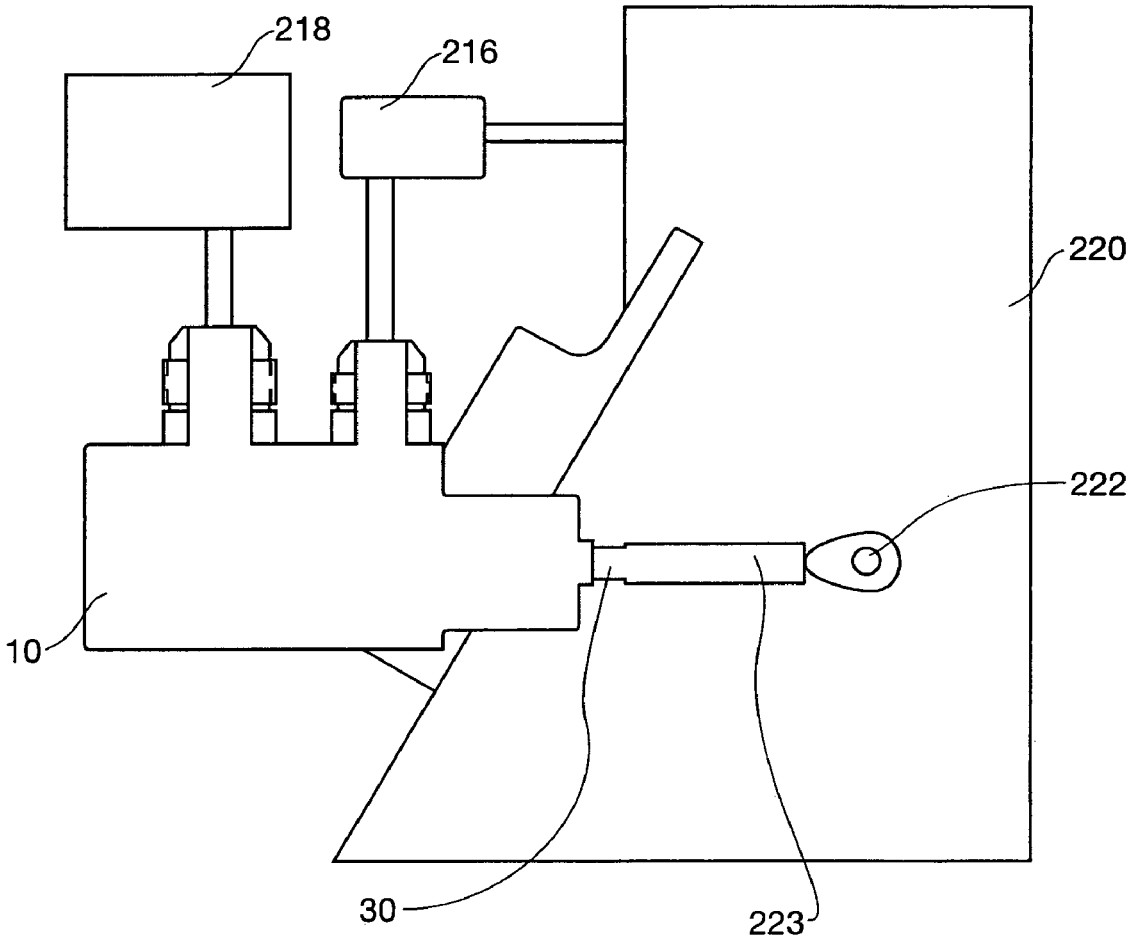
FIG. 4 shows the pump as mounted to an internal combustion engine.

FIG. 4 shows an installation of an embodiment of the invention shown in FIGS. 1 and 2. A camshaft 222 or pushrod 223 of the engine 220 drives the rod 30 from a point when the piston 35 is at farthest position to the right in the pumping cycle (i.e., as in FIG. 2). As the rod 30 moves leftward against the force of the spring 40 toward the position shown in FIG. 1, wedge shaped portion 51 separates from O-ring 52, enabling fuel to flow into the chamber 23 through the inlet passageway 22 from fuel tank 218. After continued movement, plate 34 contacts O-ring 52 and pushes it to the left, while allowing fuel to pass through the spaces in plate 34.

Where the motor driving the rod 30 is a rotating camshaft, the cam drives the rod 30 to a maximum distance to the left (as seen in FIG. 1), and the position of the piston 35 with respect to the fuel chamber 23 is such that the maximum size of the fuel chamber 23 exists. At this point, the force of the spring 40 between the piston 35 and the housing 20 works against the piston 35, the fuel in the fuel chamber 23, the outlet flow control device spring 74, and fuel in the outlet passageway 24. When the cam no longer pushes against the rod 30 because of engine rotation, the spring 40 can overcome the opposing forces and move the rod 30 toward the outlet 24 and move the fuel through the outlet 24 to carburetor 216 to supply the cylinder of the engine 220. The wedge shaped portion 51 contacts the O-ring 52, sealing the intake 22 to the fuel chamber 23. The floating O-ring 52 moves downstream, pushed by the portion 51. Where the force opposing the spring 40 is small, such as when there is relatively little fuel pressure in the chamber 23, the rod 30 stays in contact with the rotating cam such that a maximum displacement of the piston 35 is realized while the cam is rotating. The piston 35 moves from a position as in FIG. 1 to its farthest right position in FIG. 2.

Where the force opposing the spring 40 between the housing 20 and the piston 35 is large enough, the force exerted by the spring 40 between the housing 20 and the piston 35 is insufficient to fully overcome the forces opposing it. This may occur when the fuel pressure in the chamber 23 is relatively high because of a relatively small or closed throttle opening yielding low flow through a downstream carburetor or fuel injector. Since the wedge shaped portion 51 does not travel as far as is shown in FIG. 2, less fuel is pushed though the outlet 24—a varied displacement. The rod 30 becomes separated from the rotating cam until the cam rotates into position such that it is again in communication with the rod 30. Then, the cam of the rotating engine again drives the piston 35 to the position of FIG. 1 and the cycle repeats. In this way, the pump 10 provides a displacement of fuel that varies according to the forces opposing the spring 40 between the housing 20 of the pump 10 and the piston 35.

Figure 3:
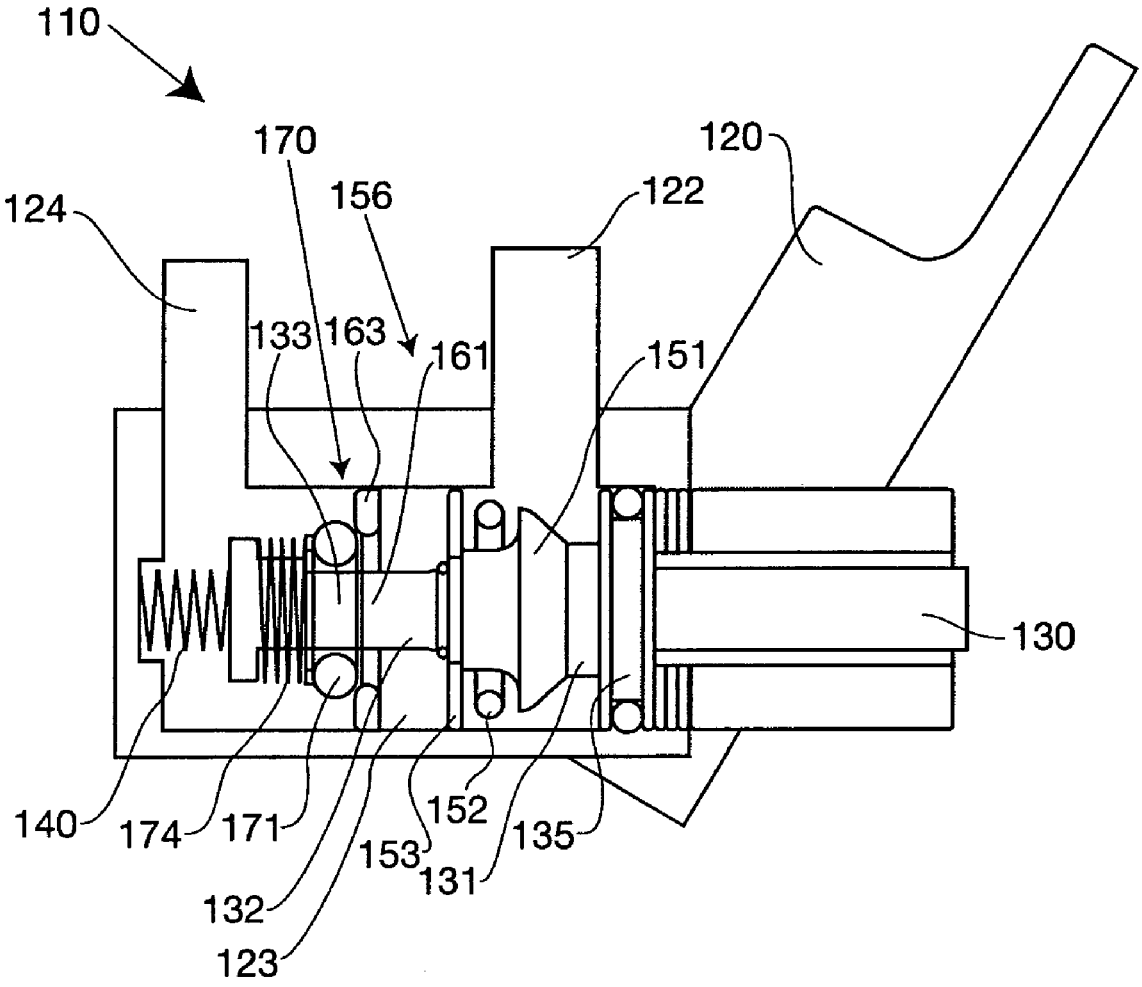
FIG. 3 is a side cross sectional view of an alternative embodiment of the fuel pump.

FIG. 3 shows an alternative embodiment of the fuel pump 110. In the illustrated embodiment, the fuel inlet passageway 122 and the fuel outlet passageway 124 are generally reversed from the embodiment of the pump 10 shown in FIGS. 1 and 2. The piston 135 is driven by a rotating cam in this embodiment to push fuel through the outlet passageway 124. A spring 140 between the piston and the housing drives the rod to bring fuel into the chamber 123. The spring 140 in this embodiment is in communication with the rod 130 at an end of the rod distal to the piston 135. The embodiment includes a spring 174 in the outlet flow control device 170 similar or identical to the spring 74 of the embodiment of FIGS. 1 and 2.

Again the wedge shaped portion 151 of the rod together with the O-ring 152 push the fuel toward the outlet 124 on a O-ring 171 has separated from shoulder 163 to open a flow path. On the return stroke the plate 153 restores O-ring 152 to position to the right.

Preferred embodiments work on the same principle as a master cylinder but with an ingenious floating O-Ring mechanism that automatically adjusts for the amount of fuel needed by the engine. It typically supplants the need for a return line on a fuel injected engine. This enables use of the pump on any engine from 200-2800 HP. An added benefit is that the pump does not add heat into the fuel from internal friction like other pumps do. The preferred embodiment also consumes less horsepower, requiring only 25 lbs of pushrod pressure compared to 125 lbs pressure of conventional pumps. The preferred embodiment also has these features:

Operates at a constant 4 to 50 PSI with most aftermarket pressure regulators, 60 lbs unregulated.

No drop in fuel pressure throughout entire RPM range.

Gasoline or Methanol can be pumped

Can be used with Carburetors or Electronic Fuel Injection

The pump only flows as much fuel as the engine requires.

No diaphragm, valves, rocker arm, block plate or gaskets

Smaller size means increased chassis clearance. This is important in oval racing because the Chevy's pump placement makes it a target when contact is made with the wall.

The pump maintains fuel pressure with the engine off for easier starting, making it ideal for fuel injection.

Weighs only 1.1 lbs. (conventional pumps weigh as much as 3.6 lbs).

The construction and operation of the fuel pump described offers numerous advantages. For example, the pump is lightweight, and can be constructed smaller than conventional diaphragm pumps, offering increased chassis clearance. In addition, the pump can be used for both methanol and gasoline applications. Also, certain modifications and improvements will occur to those skilled in the art upon a reading of the foregoing description. All such modifications and improvements, whether or not they are described or illustrated herein, may certainly fall within the scope of the following claims.

The embodiment of the pump of FIGS. 1 and 2 is a "variable displacement" design. This means that it pumps less when the demand is less. The pushrod pushes the piston on the intake stroke, the spring pushes it on the exhaust stroke. When the backpressure is high due to low demand, the spring doesn't push the piston all of the way back. At dead head pressure (60 PSI) the piston makes doesn't move, in a preferred embodiment.

Certain modifications and improvements will occur to those skilled in the art upon reading the foregoing description. It should be understood that all such modifications and improvements have been omitted for the sake of conciseness and readability, but are properly within the scope of the following claims.

What is claimed is:

1. A fuel pump comprising:

a housing defining a fuel inlet passageway, a fuel outlet passageway, and a fuel chamber;

a rod comprising a piston portion configured to decrease the volume of the fuel chamber in response to a force from a motor;

a spring between the housing and the piston, the spring biasing the piston against the force of the motor to increase the volume of the fuel chamber;

a chamber inlet flow control device in the fuel chamber for opening and sealing a portion of the chamber;

an outlet downstream of the fuel chamber; and a chamber outlet flow control device for opening the fuel chamber outlet in response to fuel pressure created when the volume of the fuel chamber is decreased.

2. A liquid fuel pump comprising:

a body having a bore with an inlet and an outlet transverse to the bore, a shaft mounted for reciprocation in the bore and having a first end upstream of the inlet, a piston downstream of the first end, a perforated plate downstream of the piston and a first O-ring engaging the shaft downstream of the perforated plate and upstream of the outlet, an annular shoulder extending into the bore downstream of the perforated plate and upstream of the first O-ring, and a second O-ring movably engaging the inside of the bore between the piston and the perforated plate downstream of the inlet, whereby reciprocation of the shaft toward the upstream end causes the first O-ring to engage the annular shoulder and the piston to separate from the second O-ring and allow liquid fuel to pass from the inlet past the piston and through the perforations in the perforated plate but not past the first O-ring, and reciprocation of the shaft toward the downstream end causes the first O-ring to separate from the annular shoulder to enable liquid fuel to flow from upstream of the shoulder to the outlet and causes the piston to engage the second O-ring and thereby occlude the bore to force liquid fuel that is downstream of the piston to move toward the outlet.

3. A liquid fuel pump as claimed in claim 2 wherein the second O-ring is moved downstream by the piston during movement of the shaft toward the downstream end and is moved upstream by the perforated plate during movement of the shaft toward the upstream end.

4. A liquid fuel pump as claimed in claim 2 wherein the bore extends upstream of the inlet to a closed end and the shaft includes a second piston reciprocating toward and away from the closed end.

5. A liquid fuel pump as claimed in claim 4 wherein the closed end is not sealed to atmosphere outside the bore.

6. A liquid fuel pump as claimed in claim 4 wherein a spring between the closed end and the second piston causes reciprocation toward the downstream end.

7. A liquid fuel pump as claimed in claim 4 wherein the second piston has a third O-ring to seal the inlet from the closed end.

8. A liquid fuel pump as claimed in claim 2 wherein the bore extends downstream of the outlet to an open end and the shaft includes a portion extending out of the open end to engage a linkage for reciprocation toward the upstream end.

9. A liquid fuel pump as claimed in claim 8 wherein the portion extending out of the open end is packed to prevent liquid fuel leakage from the open end.

10. A liquid fuel pump as claimed in claim 2 including a spring positioned to urge the first O-ring toward the annular shoulder.

11. A liquid fuel pump comprising a body having a bore with an inlet and an outlet transverse to the bore and a closed end of the bore upstream of the inlet and an open end downstream of the outlet, a shaft mounted for reciprocation in the bore and having a first end upstream of the inlet, a piston downstream of the first end, a second piston on the first end configured to reciprocate toward and away from the closed end of the bore, a perforated plate downstream of the first piston and a portion extending out of the open end of the bore to engage a linkage for reciprocation toward the upstream end, a first spring between the closed end and the second piston, a first O-ring engaging the shaft downstream of the perforated plate and upstream of the outlet, an annular shoulder extending into the bore downstream of the perforated plate and upstream of the first O-ring, a spring positioned to urge the first O-ring toward the annular shoulder, and a second O-ring movably engaging the inside of the bore between the first piston and the perforated plate downstream of the inlet, whereby reciprocation of the shaft toward the upstream end causes the first O-ring to engage the annular shoulder and the first piston to separate from the second O-ring and allow liquid fuel to pass from the inlet past the first piston and through the perforations in the perforated plate but not past the first O-ring, and the first spring causes reciprocation of the shaft toward the downstream end, which causes the first O-ring to separate from the annular shoulder to enable liquid fuel to flow from upstream of the shoulder to the outlet and causes the first piston to engage the second O-ring and thereby occlude the bore to force liquid fuel that is downstream of the first piston to move toward the outlet.

12. A liquid fuel pump as claimed in claim 11 wherein the closed end is not sealed to atmosphere outside the bore and the second piston has a third O-ring to seal the inlet from the closed end.

13. A prime mover comprising an internal combustion engine having a camshaft and a liquid fuel pump comprising a body having a bore with an inlet from a liquid fuel supply and an outlet to a carburetor or fuel injector of the internal combustion engine transverse to the bore, a shaft mounted for reciprocation in the bore and having a first end upstream of the inlet, a piston downstream of the first end, a perforated plate downstream of the piston a distal end linked to the cam shaft, and a first O-ring engaging the shaft downstream of the perforated plate and upstream of the outlet, an annular shoulder extending into the bore downstream of the perforated plate and upstream of the first O-ring, and a second O-ring movably engaging the inside of the bore between the piston and the perforated plate downstream of the inlet, whereby reciprocation of the shaft toward the upstream by the cam shaft end causes the first O-ring to engage the annular shoulder and the piston to separate from the second O-ring and allow liquid fuel to pass from the inlet past the piston and through the perforations in the perforated plate but not past the first O-ring, and reciprocation of the shaft toward the downstream end causes the first O-ring to separate from the annular shoulder to enable liquid fuel to flow from upstream of the shoulder to the outlet and causes the piston to engage the second O-ring and thereby occlude the bore to force liquid fuel that is downstream of the piston to move toward the outlet.

14. A liquid fuel system for an internal combustion engine comprising a liquid fuel supply line, a liquid fuel pumping mechanism connected to the liquid fuel supply line and having an outlet to a liquid fuel metering device for an internal combustion engine selected from the group consisting of a carburetor and a liquid fuel injector, a mechanical contact between the liquid fuel pumping mechanism and a component of the internal combustion engine transmitting a cyclic motion from the engine to the pumping mechanism to cause the pumping mechanism to pump at a cyclic rate determined by the engine, the liquid fuel pumping mechanism being a variable displacement pumping mechanism, whereby the output liquid fuel flow rate of the pumping mechanism is diminished by a sufficient backpressure at the outlet of the pumping mechanism.

15. A liquid fuel system for an internal combustion engine comprising a liquid fuel supply line, a liquid fuel pump connected to the liquid fuel supply line and having an outlet to a liquid fuel metering device for an internal combustion engine selected from the group consisting of a carburetor and a liquid fuel injector, a mechanical contact between the liquid fuel pump and a component of the internal combustion engine transmitting a cyclic motion from the engine to the pump to cause the pump to pump at a cyclic rate determined by the engine, the liquid fuel pump being a variable displacement pump, whereby the output liquid fuel flow rate of the pump is diminished by a sufficient backpressure at the outlet of the pump wherein the pump includes a reciprocating shaft and a sufficient backpressure damps the shaft's movement in one direction enough so that the shaft and engine component lose mechanical contact with one another.

16. A liquid fuel system as claimed in claim 15 wherein the engine component is selected from the group consisting of a pushrod and a cam.

17. A method of pumping liquid fuel comprising supplying liquid fuel into a bore in a body through an inlet in the body and then through a first O-ring and perforated plate, moving a shaft in a first direction in the bore to cause a piston the engage the first O-ring and occlude the bore and move a second O-ring out of contact with an annular shoulder in the bore to open a path to an outlet, continuing movement of the shaft to force liquid fuel downstream of the first O-ring towards the outlet, moving the shaft in a second direction in the bore to disengage the piston from the first O-ring and provide a liquid fuel flow path between them and move the second O-ring into contact with the annular shoulder to block the path to the outlet to resume supplying liquid fuel into the bore through the inlet and through the first O-ring and perforated plate.

18. A method as claimed in claim 17 wherein movement of the shaft in the first direction is caused by the force of a spring.

19. A method as claimed in claim 17 wherein movement of the shaft in the second direction is caused by the force of an engine component.

20. A method as claimed in claim 17 wherein movement of the shaft in the first direction is caused by the force of a spring and restrained by backpressure in a liquid fuel line connected to the outlet, causing a variable displacement.

21. A method as claimed in claim 20 wherein the backpressure damps the shaft's movement in the first direction enough so that the shaft and engine component lose contact with one another.

* * * * *